US006874344B1

(12) United States Patent
Junius et al.

(10) Patent No.: US 6,874,344 B1
(45) Date of Patent: Apr. 5, 2005

(54) COLD ROLLING METHOD

(75) Inventors: Hans-Toni Junius, Iserlohn (DE); Heinz Hofinghoff, Schalksmühle (DE)

(73) Assignee: C. D. Wälzholz-Brockhaus GmbH, Hagen (DE)

( * ) Notice: Subject to any disclaimer, the term of this patent is extended or adjusted under 35 U.S.C. 154(b) by 0 days.

(21) Appl. No.: 10/129,647

(22) PCT Filed: Oct. 31, 2000

(86) PCT No.: PCT/EP00/10711

§ 371 (c)(1),
(2), (4) Date: May 6, 2000

(87) PCT Pub. No.: WO01/32326

PCT Pub. Date: May 10, 2001

(30) Foreign Application Priority Data

Nov. 4, 1999 (DE) ..... 199 53 230

(51) Int. Cl.[7] ..... B21B 45/02
(52) U.S. Cl. ..... 72/38; 72/42; 72/201
(58) Field of Search ..... 72/38, 201, 342.2, 72/42, 236

(56) References Cited

U.S. PATENT DOCUMENTS 2,342,199 A * 2/1944 Hurtt ..... 72/38
3,276,234 A * 10/1966 Physioc, III ..... 72/53
4,247,047 A * 1/1981 Schaming ..... 239/391
4,392,367 A * 7/1983 Bald ..... 72/11.3
4,830,683 A * 5/1989 Ferguson ..... 148/648
4,885,042 A * 12/1989 Kenmochi et al. ..... 72/365.2
5,694,799 A * 12/1997 Wolpert et al. ..... 72/43
5,799,523 A * 9/1998 Seidel et al. ..... 72/9.3
5,830,535 A 11/1998 Junius et al.
5,921,487 A 7/1999 Junius

FOREIGN PATENT DOCUMENTS

DE 3150996 C * 3/1983 ..... B21B/9/00
JP 55086602 A * 6/1980 ..... B21B/1/36
SU 337163 A * 1/1973 ..... B21B/9/00

* cited by examiner

*Primary Examiner*—Lowell A. Larson
(74) *Attorney, Agent, or Firm*—Maine & Asmus

(57) ABSTRACT

The present invention relates to a method for cold-rolling metallic rolling stock (4), in which the rolling stock (4) passes through the roll nip (3) between oppositely driven rollers (2) at room temperature in order to undergo a plastic shape change. To avoid the problems caused by the use of liquid coolants and to achieve an improved surface quality of the rolling stock (4), the invention proposes that inert gas, which is at a lower temperature than the rolling-stock temperature in the roll nip, is blown into the region of the roll nip (3). The invention also relates to a cold-rolling stand for carrying out this method.

15 Claims, 1 Drawing Sheet

COLD ROLLING METHOD

The invention relates to a method for cold-rolling metallic rolling stock, in which the rolling stock passes through the roll nip between oppositely driven rollers at room temperature in order to undergo a plastic shape change. The invention also relates to a rolling stand for carrying out the rolling method according to the invention.

Cold-rolling is a process which has long been known for the shaping of continuously moving strip, profiled section or sheet made from steel or other metals. The process involves cold forming, during which—unlike in the case of hot forming—the rolling stock is not heated prior to the actual forming operation, i.e. is subjected to the plastic deformation at the prevailing ambient temperature (room temperature). This change in shape at below the respective recrystallization temperature of the metals results in advantageous changes to the properties of the deformed materials, for example an increase in the strength and hardness. Moreover, it is as a result possible to produce material surfaces with defined roughness values $R_a$, specifically both the highest surface qualities, with a roughness average in accordance with DIN 4768/1 $R_a<0.3$ $\mu$m—crack and pore free (RP) or crack and pore free and brightly shining (RPG)—and roughened surfaces with $R_a>1.5$ $\mu$m. Consequently, the surfaces can be optimally adapted to the requirements for subsequent processing steps. In principle, all cold-formable metal materials can be processed in this way, i.e. steel, nonferrous metals, aluminum and other alloys. For example, cold-rolled steel sheet is eminently suitable for direct further processing even with the highest quality demands, for example those encountered in the automotive engineering sector.

To produce such high, defined surface qualities, harmful influences which can lead to an undefined roughening of the surface have to be as far as possible ruled out or controlled by suitable measures. As the rolling stock passes through the roll nip, harmful influences of this type result, inter alia, from the fact that the material surface and the roll surfaces, in the region of their contact surface outside the neutral point, are in principle at different web velocities, which leads to mechanical frictional loads on the surfaces. The frictional heat which is generated, together with the evolution of heat caused by internal friction as a result of the deformation energy supplied, leads to considerable heating of the rolling stock in the roll nip. This thermal loading of the material additionally promotes adverse effects on the surface caused by changes in the materials properties and by oxidation.

In the prior art, the abovementioned mechanical and thermal loads on the strip surface are combated by using coolants which are liquid at room temperature. Before it enters the roll nip, the rolling stock is continuously wetted with water, oil or emulsions. As a result, the rolling stock is simultaneously cooled and lubricated, so that the required surface qualities can be produced.

However, a significant drawback of the above-mentioned liquid coolants is that, during rolling, to some extent they remain on the surface, where they have adverse effects. For example, water and water-containing emulsions lead to corrosion, i.e. to the formation of rust in the case of steel sheet or strip. Oil and oil-containing emulsions leave residues of oil on the surface, and these have to be removed again, as far as possible without leaving any residues, prior to the further processing by welding, electrochemical surface treatment or the like, using further operations, which are relatively complex and often environmentally polluting. Of course, this entails very considerable outlay in terms of labor, time and cost.

In view of the above, the present invention is based on the object of providing a cold-rolling method and a cold-rolling stand for carrying out this method which as far as possible avoids the above problems caused by the use of conventional coolants. In particular, it is intended to ensure sufficient cooling and lubrication in the roll nip, while as far as possible there should be no harmful residues remaining on the rolling stock.

To solve the above problems, the method according to the invention proposes that inert gas, which is at a lower temperature than the rolling-stock temperature in the roll nip, is blown into the region of the roll nip.

According to the method according to the invention, the roll nip or the rolling stock which is passing through the roll nip has inert gas locally passing around it. The inert gas used is a nonoxidizing gas, for example nitrogen, noble gases, carbon dioxide or other gases and gas mixtures which do not attack the surface of the rolling stock, i.e. do not cause any corrosion to this surface. According to the invention, this inert gas should be cooler than the rolling stock in the roll nip. This means that the inert gas temperature should be at least below the maximum temperature of the material which occurs during the deformation in the roll nip. Since this temperature of the material, on account of the thermal influences which have been outlined above, is higher than ambient temperature even during cold-rolling, the method according to the invention is effective even if the inert gas temperature is at or slightly below ambient temperature (room temperature).

The method according to the invention is based on the surprising discovery that a targeted stream of inert gas simultaneously produces effective dissipation of heat from the roll nip, a corrosion-inhibiting action and, a particularly unexpected phenomenon, considerable reduction in the friction in the roll nip. This means that, according to the invention, gas cooling and lubrication is achieved for the first time in the cold-rolling process.

The inert gas which is blown in in the region of the roll nip locally forms a protective atmosphere in the region of the roll nip, which reliably prevents corrosion, for example oxidation of the surfaces of the rolling stock and also of the roll surfaces in the region of the roll nip. Unlike conventional, liquid coolants, the inert gas provides particularly good protection against oxidation, on account of the fact that the ambient air is displaced without leaving any residual air.

As a result of the temperature gradient with respect to the rolling stock, which is locally heated in the roll nip during deformation, the inert gas which is flowing past and is cooler than the rolling stock in that region produces effective cooling of the rolling stock in the direct region of the roll nip. Consequently, the thermal loads on the surfaces fall in that region. This gas cooling is probably particularly effective because the cooling gas penetrates a relatively long way into the roll nip between roll surface and rolling-stock surface.

Surprisingly, it has also emerged that the inert gas which is blown in according to the invention reduces the friction between the roll surface and the rolling-stock surface to such an extent that additional lubrication is no longer required. One possible explanation for this unexpected, positive lubrication effect is based on the possibility that a microscopically thin film of the inert gas is adsorbed on the rolling-stock surface, which is cooled by the inert gas flowing past it, and possibly also on the roll surface. As a result, it appears that a type of gas cushion is formed in the roll nip, i.e. at the point of contact between the rolling-stock surface and the roll surface, so that an improved lubricating effect is produced compared to the use of liquid lubricants which has hitherto been customary.

The method according to the invention therefore demonstrates for the first time a way of replacing the coolants which are liquid at room temperature and have hitherto been considered imperative, such as water, oil or emulsions, with a cooling gas which is in gas form at room temperature.

The particular advantages of the method according to the invention result from the fact that all the drawbacks of liquid coolants are completely eliminated. In particular, the inert cooling gas does not leave behind any harmful residues whatsoever on the rolling stock, and consequently there is no longer any need for any separate operations for degreasing, removal of rust or the like prior to the further processing. Rather, the rolling stock can be directly processed further immediately after rolling, for example by welding, electrochemical surface treatment, enameling or deformation or the like. Moreover, the inert gas suppresses oxidation phenomena much more effectively than would be possible with known coolants.

The fact that the service life of the working rolls, in particular for the highest surface quality RPG (free of cracks and pores, brightly shining), is considerably increased has proven to be a further, extremely positive additional effect. This is, of course, particularly advantageous since the rolls have to be replaced and reworked correspondingly less frequently. The same is true of surface qualities with higher, defined roughnesses, i.e. the predetermined $R_a$ values can be reproduced for a longer time.

Preferably, the inert gas is blown in such a way that it is directed onto the boundary of the contact surface in the roll nip between rolling stock and roller. This controlled injection of the inert gas into the regions where the rolling stock enters and leaves the roll nip results in particularly good local cooling of the rolling stock at locations where the maximum thermal loads occur. Furthermore, it is ensured that atmospheric oxygen which is entrained by the roll and rolling-stock surfaces is reliably displaced and is not carried into the roll nip. Furthermore, the lubricating action of the gas lubrication according to the invention is also improved by the directed blowing onto the edge of the boundary surface.

The inert gas is preferably blown in at the rolling-stock entry and at the rolling-stock exit. This ensures particularly good cooling and reliable shielding from harmful atmospheric oxygen. In individual cases, however, it may even be sufficient for the inert gas to be supplied at the rolling-stock entry or at the rolling-stock exit.

The inert gas is expediently supplied at least on the top side of the rolling stock. This arrangement exploits the fact that the cold inert gas is heavier than ambient air and therefore also flows around the underside of the rolling stock and the lower roll purely under the influence of the force of gravity.

As has been explained above, for cooling purposes the inert gas should at least be at room temperature; even at this temperature, it is cooler than the rolling stock, which is at a higher temperature than room temperature in the roll nip. However, the advantageous effects with regard to cooling and lubrication are further improved by the inert gas temperature being below room temperature. Even slight cooling has noticeable positive effects which, of course, is particularly advantageous with regard to relatively great roll widths with a relatively high demand for cooling gas. However, the lower the inert gas temperature, the more the inventive advantages come to bear. Therefore, if quality requirements demand, cryogenic gas at a temperature of approximately −60° C. to −150° C. is used.

A particularly advantageous embodiment of the method according to the invention provides for the inert gas to be blown at below its liquefaction temperature. The inert gas, for example nitrogen, which is in gas form under standard conditions (room temperature, standard pressure) is in this case cooled to such an extent that it adopts the liquid state of aggregation. It is then blown or injected, in accordance with the method according to the invention, into the region of the roll nip in the form of a liquefied gas. Unlike the known coolants which are liquid at room temperature, this liquefied gas, when it is heated to room temperature, passes into the gaseous state of aggregation without any residues, and consequently leaves no more harmful residues on the rolling stock than if it had been blown in in gas form.

The considerably improved cooling action when using liquefied gas results from its extremely low temperature and from the fact that it extracts all its evaporation energy for transition into the gaseous state of aggregation as thermal energy from the environment, with the result that relatively large amounts of heat are dissipated from the rolling stock within a short time. Consequently, the rolling stock enters the roll nip at a very low temperature. The heat of deformation which is generated in the roll nip is dissipated almost immediately at the rolling-stock exit by the liquefied-gas cooling. The thermal load on the surfaces, specifically both on the rolling-stock surfaces and the roll surfaces, is in this way reduced to a minimum. Moreover, the differences in temperature result in the formation of a gas cushion on the contact surface in the roll nip, so that the rolling friction and therefore the mechanical loads on the surfaces are likewise greatly reduced. Finally, the low surface temperatures effectively reduce the surface corrosion caused by oxidation, even if the rolling stock or the roll surface leaves the region around the roll nip to which inert gas is supplied directly.

Initial tests have shown that the use of the liquefied gas, specifically liquid nitrogen, under otherwise identical conditions results in a sudden improvement in the quality of the strip surface from RP (free of cracks and pores) to RPG (free of cracks and pores, brightly shining). At the same time, the service life of the rolls is extended by a multiple. The effect whereby the roll surface becomes matt after a certain time, as has hitherto been observed but cannot be accepted for the qualities RP and RPG and the causes of which are as yet unclear, likewise no longer occurs in the method according to the invention.

The method according to the invention is preferably carried out for the cold-rolling of steel, in particular strip steel and steel sheet, and specifically in particular for high surface qualities in accordance with DIN EN 10139. However, the method according to the invention is not restricted to the processing of steel, but rather may, of course, also be used for the cold-rolling of other cold-formable metal materials, for example of nonferrous metals, aluminum and further metals and alloys.

To summarize, it can be stated that the invention for the first time shows a possible way of completely replacing the coolants which are liquid at room temperature and have hitherto been customary with a cooling gas which is in gas form at room temperature. The particular advantages result from the fact that all the problems which have hitherto been caused by the coolants themselves are eliminated and, at the same time, the surface quality achieved during the cold-rolling is considerably improved, practically without any additional outlay.

The method according to the invention can be implemented with relatively little design outlay on a cold-rolling stand for the cold-rolling of metallic rolling stock, which has at least two rolls (working rolls) which are mounted in a rolling frame in such a manner that they can be driven in opposite directions and between which the roll nip, through which the rolling stock passes, undergoing a change in shape, is located. According to the invention, this stand has nozzles which can be supplied with cold inert gas and which are directed at the roll nip.

The inert gas can be blown into the region of the roll nip over the entire width of the rolling stock through these nozzles, with their gas outlet preferably oriented substantially tangentially with respect to the roll surface, i.e. the inert gas can, as described, be blown onto the boundary of the contact surface between the rolling-stock surface and the roll surface.

The nozzles are expediently arranged at the rolling-stock entry and at the rolling-stock exit. They should be arranged at least on the top side of the rolling stock. This arrangement is often sufficient, since the cold inert gas will flush around the underside of the rolling stock purely under the force of gravity. However, if appropriate it is also possible for nozzles to be arranged on the underside of the rolling stock.

Depending on the required cooling action and surface condition of the rolling stock, it is possible to supply cryogenic gas or liquefied gas to the nozzles.

Another advantageous alternative or refinement of the present invention provides for a reactive gas, which can undergo chemical reactions with the surface of the rolling stock in order to achieve defined surface properties, to be used instead of the inert gas, which is passive with respect to the surfaces of the material. The use of this reactive gas likewise avoids the problems caused by the use of liquid coolants which form the starting point for the invention. Specifically, the reactive gas can likewise produce sufficient cooling and lubrication in the roll nip, without any harmful residues remaining on the rolling stock, in the same way as when using inert gas.

The effects relating to the gas cooling and lubrication according to the invention of the rolling stock in the roll nip, which have been explained above and have thus far not been scientifically explained with any definitive reliability, can likewise be achieved by the reactive gas, which is supplied at a cool temperature. The atmospheric oxygen, which may have harmful effects on the surface properties of the rolling stock and of the rolls in the roll nip, is displaced by the reactive gas. In addition to these effects, which can already be achieved with inert gas, still further advantages can be achieved through the use of reactive gas. For example, it is conceivable for the reactive gas, which is initially supplied in cooled form, to react in a controlled way with the material surface of the rolling stock as a result of the heating in the roll nip. In this way it would, for example, be conceivable to apply reactively applied protective layers to the surface of the rolling stock, specifically in particular before the rolling stock comes into contact with the ambient air. This could provide particular advantages in particular with reactive metals, such as for example aluminum.

Suitable reactive gases are all gases or gas mixtures which, under suitable conditions, for example in defined temperature ranges, can react in a predeterminable way with the corresponding material of the rolling stock. For example, it is conceivable to use carbon dioxide and other inorganic or organic gases or gas mixtures.

A cold-rolling stand according to the present invention is explained in more detail below with reference to the drawings, in which, in detail:

Figure 1:
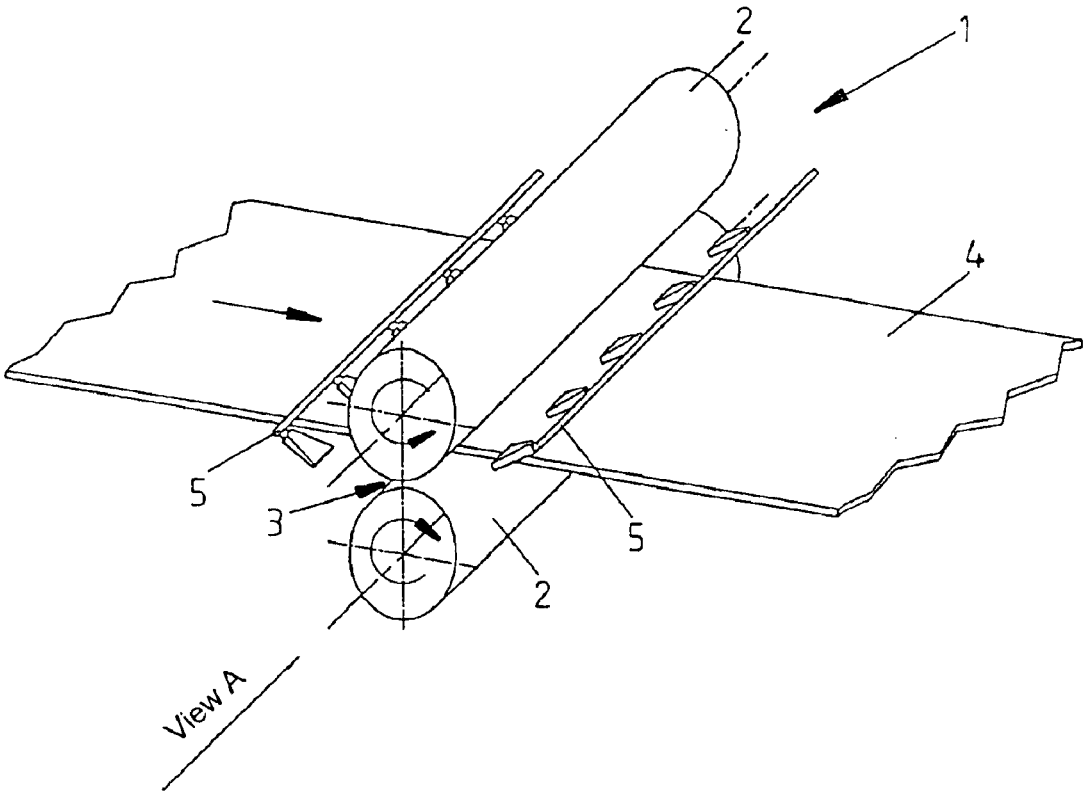
FIG. 1 shows a diagrammatic perspective view of a rolling stand according to the invention.

FIG. 1 diagrammatically depicts a perspective view, at an angle from above, of a cold-rolling stand according to the invention, in which the rolling frames have been omitted for the sake of clarity. This cold-rolling stand, which is denoted overall by reference 1, has two rolls 2 which are arranged vertically above one another and between which the roll nip 3 is located.

In the illustration, the rolling stock is formed by a metal strip or sheet 4, for example of steel, which is passing through the roll nip 3 in the direction indicated by the arrow.

Reference 5 denotes nozzles which are arranged on the strip entry side and the strip exit side of the rolling stand 2 and the gas outlets of which are directed obliquely from above into the region of the roll nip 3.

Figure 2:
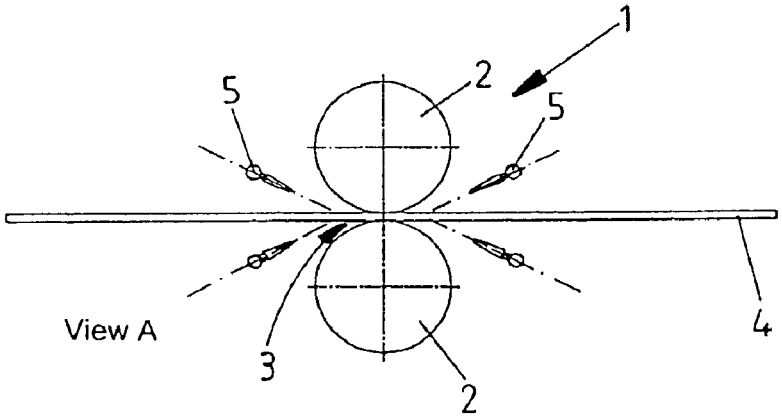
FIG. 2 shows a side view of the rolling stand shown in FIG. 1.

The arrangement of the individual parts can be seen once again, particularly clearly, from the side view shown in FIG. 2. This figure indicates additional nozzles 5 on the underside of the rolling stock 4, which are likewise directed at the roll nip 3.

A cryogenic fluid may be injected or blown into the boarder of the contact surface of the roll nip according to one embodiment the present invention. This cryogenic fluid may, as has been disclosed above, be in either a gaseous or liquid phase when injected by the nozzle. The cryogenic fluid, selected according to one embodiment of the present invention, is a gas at ambient or room temperature. This injection provides at least three benefits: it lubricates the roll nip and the rolling stock; it cools the roll nip and the rolling stock at a contact surface between the roll nip and the rolling stock; and it displaces ambient gasses from the contact surface.

To operate the cold-rolling stand 1, the rolls 2 are driven in rotation in a known way, with the result that the rolling stock 4 passes through the roll nip 3, undergoing a change in shape as it does so. In accordance with the invention, inert gas, specifically, for preference, cold or cryogenic gas or liquefied gas, for example nitrogen, is supplied to the nozzles 5. This results in effective local cooling of the rolling stock 4 in the region of the roll nip 3. The local protective atmosphere in the region of the roll nip 3 reliably prevents oxidation. The inert gas immediately ensures reliable lubrication between the roll and rolling-stock surfaces, so that there is no need for any further coolants or lubricants.

It is also possible to use reactive gas instead of chemically passive inert gas. This gas is distinguished by a defined chemical reactivity with the material of the rolling stock. In addition to the gas cooling and lubrication according to the invention without the use of liquid coolants, it is in this way possible to deliberately influence the surface during the rolling operation, for example to form surface protective layers.

What is claimed is:

1. A method for cold-rolling metallic stock, said method comprising:

passing rolling stock through a roll nip disposed between two oppositely driven rollers;

injecting a cryogenic fluid, in a liquid phase, into a contact surface of said rolling stock immediately adjacent to said roll nip, said cryogenic fluid being a gas at ambient temperature;

lubricating said roll nip and said rolling stock with said cryogenic fluid;

cooling said roll nip and said rolling stock at a contact surface between said roll nip and said rolling stock with said cryogenic fluid; and inducing a plastic shape change in said rolling stock.

2. The method according to claim 1 wherein said cryogenic fluid is injected across the full width of the rolling stock at the roll nip.

3. The method according to claim 1 wherein said cryogenic fluid is inert and further comprising the step of displacing ambient gasses from between said contact surface and said roller at said roll nip with said cryogenic fluid.

4. The method as claimed in claim 1, characterized in that the fluid is injected substantially tangentially with respect to a roll surface of at least one said roller.

5. The method as claimed in claim 1, characterized in that the fluid is injected at the rolling-stock entry and/or at the rolling-stock exit.

6. The method as claimed in claim 1, characterized in that the fluid is supplied at least on the top side of the rolling stock.

7. The method as claimed in claim 1, characterized in that the fluid temperature is at least at or below room temperature.

8. The method as claimed in claim 1, characterized in that said fluid is nitrogen.

9. The method as claimed in claim 1, characterized in that said fluid is a noble gas.

10. The method as claimed in claim 1, characterized in that said fluid comprises a mixture of fluids.

11. The method as claimed in claim 1, characterized in that the rolling stock is strip steel.

12. The method as claimed in claim 1, characterized in that the rolling stock is steel sheet.

13. The method as claimed in claim 1, further comprising imparting an average roughness (Ra) of 0.03 to 1.5 $\mu$m (in accordance with DIN 4768/1) to said rolling stock.

14. A method for cold-rolling metallic stock, said method comprising:

(a) admitting a sheet of rolling stock into an inlet side of a roll nip disposed between two oppositely driven rollers;

(b) injecting a steam of cryogenic fluid, in a liquid phase, on at least said inlet side of said roll nip onto substantially the full width of at least one contact surface of said sheet immediately adjacent said roll nip and substantially tangent to the surface of the respective said roller;

(c) lubricating said contact surface of said sheet and said surface of said roller in said roll nip with said cryogenic fluid;

(d) cooling said contact surface of said sheet and said surface of said roller in said roll nip with said cryogenic fluid; and thereby (e) inducing a plastic shape change in said sheet.

15. The method according to claim 14, wherein said cryogenic fluid is substantially free of oxidizing agents and is converted to a gaseous state by cooling said contact surface and further comprising the step of displacing ambient gasses from between said contact surface and said roller at said roll nip with said cryogenic fluid.

* * * * *

UNITED STATES PATENT AND TRADEMARK OFFICE

CERTIFICATE OF CORRECTION

PATENT NO. : 6,874,344 B1
DATED : April 5, 2005
INVENTOR(S) : Hans-Toni Junius et al.

It is certified that error appears in the above-identified patent and that said Letters Patent is hereby corrected as shown below:

Title page,
Item [86], § 371 (c)(1), (2), (4), delete "May 6, 2000" insert -- May 6, 2002 --.

Signed and Sealed this

Twenty-fourth Day of January, 2006

JON W. DUDAS
*Director of the United States Patent and Trademark Office*